United States Patent [19]

Scheithauer

[11] Patent Number: 4,817,270

[45] Date of Patent: Apr. 4, 1989

[54] METHOD OF MANUFACTURING A HEAT COIL ASSEMBLY FOR A PROTECTOR UNIT

[75] Inventor: Eric A. Scheithauer, Chicago, Ill.

[73] Assignee: Northern Telecom Limited, Montreal, Canada

[21] Appl. No.: 94,082

[22] Filed: Sep. 4, 1987

Related U.S. Application Data

[62] Division of Ser. No. 853,952, Apr. 21, 1986, abandoned.

[51] Int. Cl.[4] ..... H01H 39/00

[52] U.S. Cl. ..... 29/622; 29/860; 29/802.1

[58] Field of Search ..... 29/602 R, 605, 606, 29/854, 860, 622; 361/91, 93, 117, 118, 119, 124

[56] References Cited

U.S. PATENT DOCUMENTS

| | | | |
|---|---|---|---|
| 3,743,888 | 7/1973 | Baumbach | 361/119 |
| 3,818,271 | 6/1974 | Baumbach | 361/119 X |
| 3,849,750 | 11/1974 | Baumbach et al. | 361/119 X |
| 4,168,515 | 9/1979 | Baumbach | 361/119 X |
| 4,314,304 | 2/1982 | Baumbach | 361/119 X |
| 4,396,969 | 8/1983 | Fasano | 361/119 X |
| 4,502,088 | 2/1985 | Baumbach | 361/119 X |
| 4,583,954 | 4/1986 | Chapman, Jr. et al. | 29/756 |
| 4,594,635 | 6/1986 | Scheithauer et al. | 361/119 |

*Primary Examiner*—A. D. Pellinen
*Assistant Examiner*—Jeffrey A. Gaffin
*Attorney, Agent, or Firm*—Foley & Lardner, Schwartz, Jeffery, Schwaab, Mack, Blumenthal & Evans

[57] ABSTRACT

The heat coil assembly for a protector unit is formed of a line terminal, an intermediate member and a pin forming a single unit, with a spool mounted on the upper end of the pin and attached by a layer of fusible alloy. A coil on the spool has one end connected to the heat coil assembly and the other end connected to a second line terminal. The coil can be wound on the spool after attaching to the pin to form an assembly for positioning in a base of a protector. A protector may have two such heat coil assemblies, with associated primary gap protectors, and ground member. Back-up protector devices may also be provided, with line members connecting each heat coil assembly to a related back-up protector.

9 Claims, 3 Drawing Sheets

METHOD OF MANUFACTURING A HEAT COIL ASSEMBLY FOR A PROTECTOR UNIT

This application is a division of application Ser. No. 853,952, filed Apr. 21, 1986, now abandoned.

This invention relates to overload protectors for communications systems, and in particular is concerned with a heat coil and line pin assembly of a protector.

Overload protectors usually combine an overvoltage protection device comprising two opposed electrodes spaced to define a gap. One electrode is connected to a telephone line terminal and the other is connected to a ground terminal. On occurrence of a voltage above a predetermined value on the telephone line, there is a spark breakdown across the gap to ground. One such overvoltage device is provided for each line of a telephone or other communication system, that is Tip and Ring. There is also provided an overcurrent device normally comprising a coil connected between the central office and outside line terminals. On occurrence of a current above a predetermined value, the coil heats up and causes a fusible metal joint to melt, permitting movement of one member relative to another and connecting the line to ground. One such device is again provided for each line and the device will also operate if there is a continuous spark breakdown due to a constant overvoltage condition. Heat is conducted from the spark gap device to the fusible metal joint and melts the fusible metal.

It will be appreciated that large numbers of protectors are required and it is desirable that the cost be as low as possible. The assembly of protectors can be labour intensive and thus any reduction in labour content will assist in reducing costs. One particular feature which requires careful assembly is the heat coil assembly.

A heat coil assembly generally comprises a coil of wire wound onto a spool. The spool has a central bore into which is placed a pin. The spool and pin are joined by a fusible alloy, with the pin extending from one end of the spool. One end of the wire is connected to the central office terminal in the protector and the other end is connected to the line terminal. It is usually necessary to wind the coil after the spool has been joined to the pin. The joined spool and pin are then assembled to the rest of the protector assembly and the ends of the wires connected. It would assist in assembly if the line terminal, spool and pin could be preassembled, then the wire wound onto the spool. Normally, this cannot be done as there are two line terminals in the base of the protector and access to wind is not possible.

In the present invention, the pin and line terminal are formed as a unitary member, either by forming a single part or by rivetting or otherwise joining individual sections together. The spool can then be mounted on the pin and the wire wound onto the spool. One end of the wire is attached to the spool, or pin, prior to winding. The terminal, pin, spool and coil unit is then assembled to a protector base, and the other end of the wire connected to the central office terminal.

Thus, in the broadest aspect of the invention, a heat coil assembly for a protector unit comprises a line terminal having a terminal portion and a pin portion forming an integral unit, a spool mounted on the pin portion and joined thereto by a fusible alloy, the spool capable of sliding axially on the pin portion on fusing of the fusible alloy, and a coil wound on the spool, one end of the coil connected to the spool, pin portion or line terminal portion. The invention also provides a protector having an overvoltage protection device having one electrode connected to a ground terminal and another electrode connected to the heat coil assembly. A protector may have two heat coil assemblies and two overvoltage protection devices, within a casing, and a back-up protection device may be positioned between each heat coil assembly and the ground terminal, in parallel arrangement with the overvoltage protection devices.

The invention will be readily understood by the following description of certain embodiments, by way of example, in conjunction with the accompanying drawings, in which.

Figure 1:
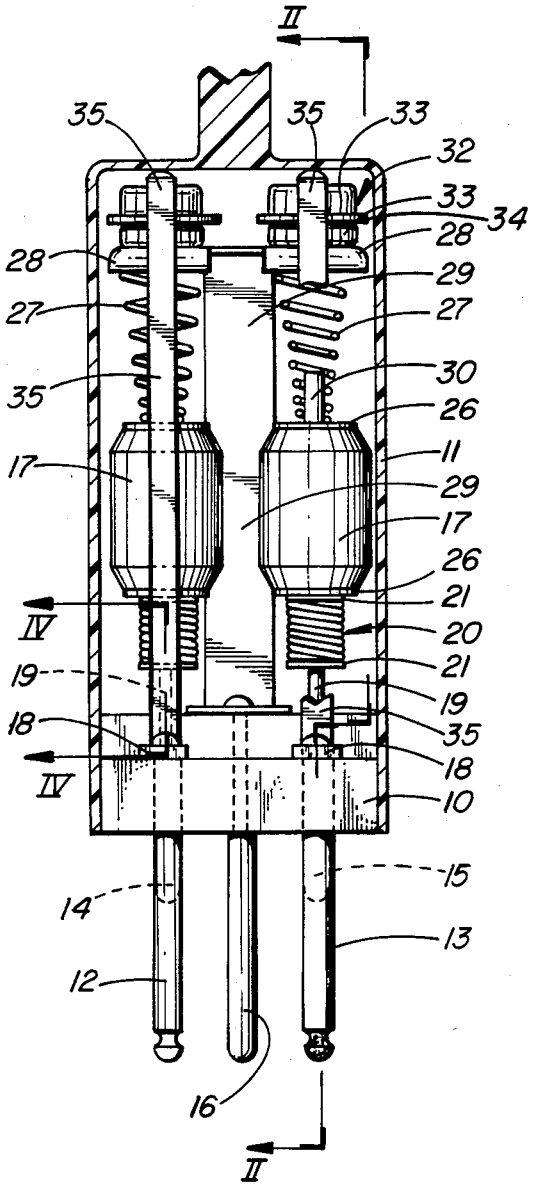
FIG. 1 is a front view of one form of protector with the front wall of the housing removed, as on the line I—I of FIG. 2.
Figure 2:
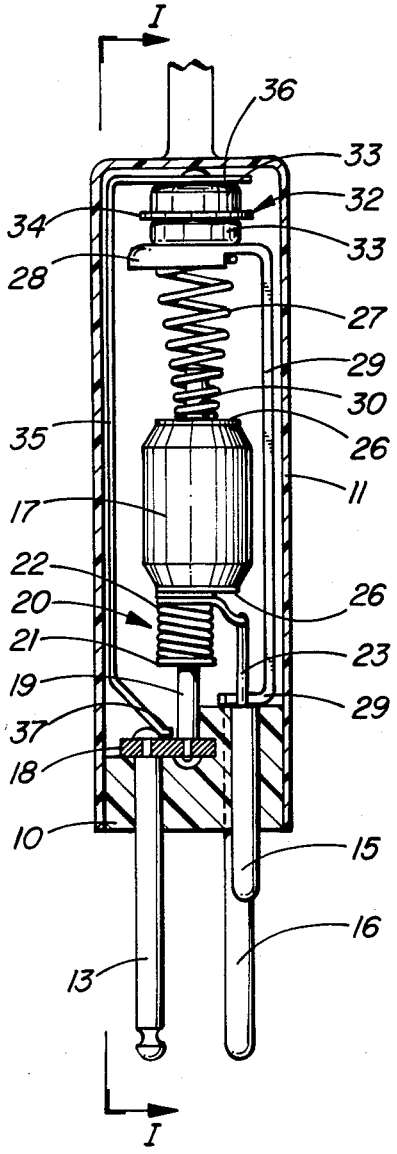
FIG. 2 is a cross-section on the line II—II of FIG. 1.

As illustrated in FIGS. 1 and 2, a protector has a base 10 and a housing 11 which is generally removably attached to the base, but may also be permanently attached. There are five terminals or pins extending through the base 10, two line terminals 12 and 13 for connecting to outside lines, two line terminals 14 and 15 for connecting to central office lines, and a ground terminal 16 for connecting to a ground. Mounted within the housing are two protector devices 17, in the present example gas tube protector devices. The arrangement as illustrated in FIG. 1 is symmetrical about a vertical center line, with one protector device 17 for one line, for example Tip, and another protector device 17 for the other line, that is Ring. For convenience, only one protector device and associated items will be described in detail but the description applies to the other device unless otherwise stated.

Considering FIG. 2, the line terminal 13 extends up through the base 10 and at its upper end is rivetted, or otherwise attached, to a short, laterally extending plate 18. The terminal 13 is attached at one end of the plate 18, and at the other end is attached a pin 19 extending upward away from the base 10. At the upper end of the pin 19 is positioned a coil assembly 20. The coil assembly comprises a spool 21 and a coil of wire 22 wound on the spool. The spool is attached to the pin by a fusible alloy. One end of the wire 22 is connected to the spool while the other end is connected to an extension 23 of the central office terminal 15.

Thus a connection exists between the two line terminals, 13 and 15, via plate 18, pin 19, spool 21 and wire 22. Also, as the spool 21 contacts the bottom electrode of the protector device 17 there is a connection from the line to the bottom electrode.

Figure 3:
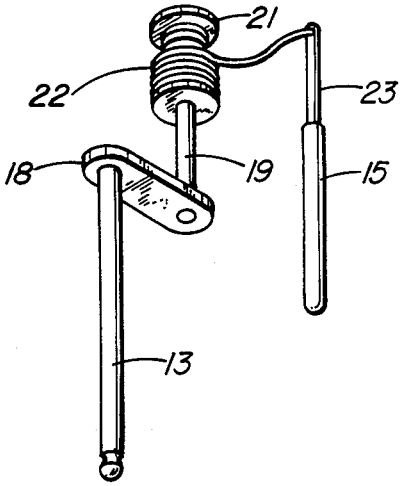
FIG. 3 is a perspective view of a line terminal and coil assembly.
Figure 4:
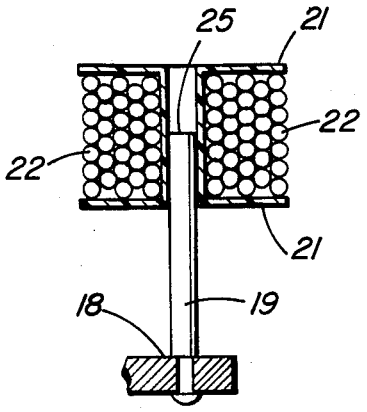
FIG. 4 is a cross-section, on the line IV—IV of FIG. 1, of a pin and coil.

The terminal 13, plate 18, pin 19, spool 21 and wire 22 are seen in perspective in FIG. 3, together with the terminal 15 and extension 23. The plate 18, pin 19, spool 21 and wire 22 are seen in cross-section in FIG. 4. The thin layer of fusible alloy between the spool and pin is indicated at 25.

The protector device 17, as an example, comprises two electrodes in opposition, spaced apart to define an arc gap. The electrodes are sealed in a ceramic tube with the gap at a sub-atmospheric pressure. The electrodes each have a flange, 26, which extends beyond the ceramic tube. At the lower end the spool 21 is in contact with the flange 26 of the lower electrode. The flange at the upper end is contacted by a compression spring 27. The upper end of the spring 27 rests in and is in contact with a shallow cup or recess 28 at the upper end of a ground member 29. The ground member extends down to the base 10 and is attached to the ground terminal 16 (FIG. 1). The lower end of the spring is located by a central pin 30 extending up from the flange 26 of the upper electrode.

As stated, the arc gap in the device 17 is at sub-atmospheric pressure. If the seal between an electrode and the ceramic tube breaks, the device becomes vented to atmosphere and the breakdown voltage is too high. Therefore, a back-up gap device is usually provided for each line. These are indicated at 32. Each back-up device comprises two electrodes 33 spaced by and bonded to a thin disc 34 of dielectric material, such as Mylar (trademark). The disc has a small hole at its center and acts to define a gap between the electrodes 33.

As seen in FIG. 1, the ground member 29 has two cups or recesses 28 at its top end, one for each line. The back-up devices 32 are positioned on the top, outer surfaces of the cups 28. A line member 35 has its top end 36 extending over the top of a back-up device and the line member extends down inside the housing 11 and is in contact at its lower end 37 with the plate 18. A line member 35 is provided for each line and the associated protector device 17 and back-up device 32. The line members are pressed into contact with the back-up devices 32 at the upper ends and into contact with plates 18 at their lower ends on assembly of the housing 11 to the base 10.

Figure 5:
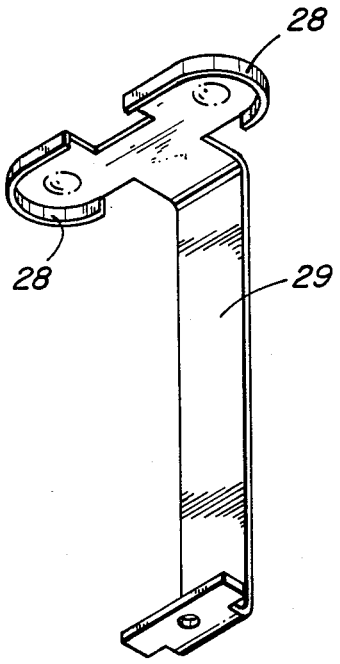
FIG. 5 is a perspective view of the ground bar as used in the arrangement of FIGS. 1 and 2.
Figure 6:
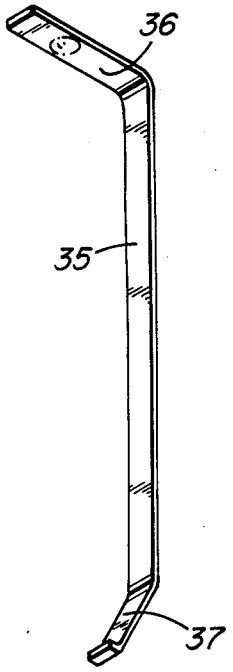
FIG. 6 is a perspective view of a line bar as used in the arrangement of FIGS. 1 and 2.

The ground member 29 and line member 35 are seen in perspective in FIGS. 5 and 6 respectively.

Figure 7:
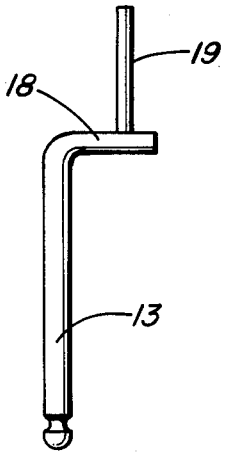
FIG. 7 and 8 are front and side views of an alternative form of line terminal and pin.
Figure 8:
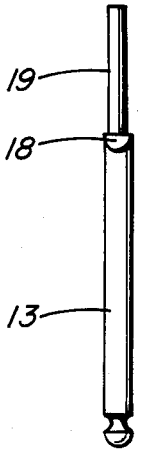

FIGS. 7 and 8 illustrate an alternative form of line terminal, for example terminal 13. The terminal, plate and pin are formed in one piece from wire. Other forms can be used.

The operation is conventional. On occurrence of an overvoltage on a line, there is a spark or arc breakdown of the gap in the related device 17. In the event that the gap of the device 17 becomes vented, or otherwise inoperative, then the gap in the related back-up device 32 becomes effective, breaking down at a voltage slightly higher than the gap in the device 17.

In the event of an overcurrent on a line, then the coil assembly 20 associated with the line heats up and eventually the fusible alloy layer 25 melts. This permits the spool 21 to be pushed down on the pin 19, until the bottom of the spool contacts the bottom end of the ground member 29, thus providing a ground connection. This can also occur if there is a continuous breakdown due to a continuous overvoltage condition. Heat is transmitted from the bottom electrode of the device 17 to the spool 21 and thus melts the fusible alloy.

Thus in normal breakdown on occurrence of an overvoltage, the ground connection is via the gap in device 17 and spring 27 to the ground member. In a back-up condition, the ground connection is via the line member 35, the back-up gap in device 32 to the ground member. In an overcurrent or continued overvoltage condition, grounding occurs between the spool and the ground member.

It will be seen that the line pins 12 and 13, with plates 18, pins 19 and coil assemblies 20, each constitute a unitary assembly provided prior to assembly in the protector. The spools 21 are joined to the pins 19 by the fusible alloy, and the pins 19 and the terminals 12 and 13 attached to the plates. It is thus possible to wind the wire 22 onto the spools prior to assembly to the protector, but after the spool, pin, plate and terminal have been assembled into a unit. The pins 12 and 13, with plates and coil assemblies, can be positioned in the base and the free end of the wire connected to the other pins 14 and 15. The protectors 17 and springs 27 are then assembled and positioned with the protector resting on the spool. The ground member 27 is attached to the ground terminal 16 prior to assembly and the ground member is assembled to the base by sliding the ground terminal into a bore through the base 10. The cup or recess 28 fits over the outer end of the spring. The line member is then assembled with its lower end resting on the plate 18 and its upper or outer end extending over the back-up device 32. The whole is then pushed into the housing 11. The free length of the line member 35 is slightly longer than in its fully assembled condition, the lower end bending slightly on final assembly. The tapered spring 27 acts to center the protector 17. The assembly comprises a set of separate, removable and replaceable parts, if repair is desired for example.

If a back-up gap device is not required, then the device 32 can be left out and a spacer inserted, although a back-up device is generally always used with gas tube protectors.

The invention can also be applied to non gas-tube protectors, for example, carbon block protectors. Carbon block protectors are not usually sealed into a housing, being at ambient pressure. Therefore venting does not occur. Also, carbon block protectors usually fail by having a reduced breakdown voltage or by developing a direct short between the electrodes. Thus, a back-up device is not required.

Figure 9:
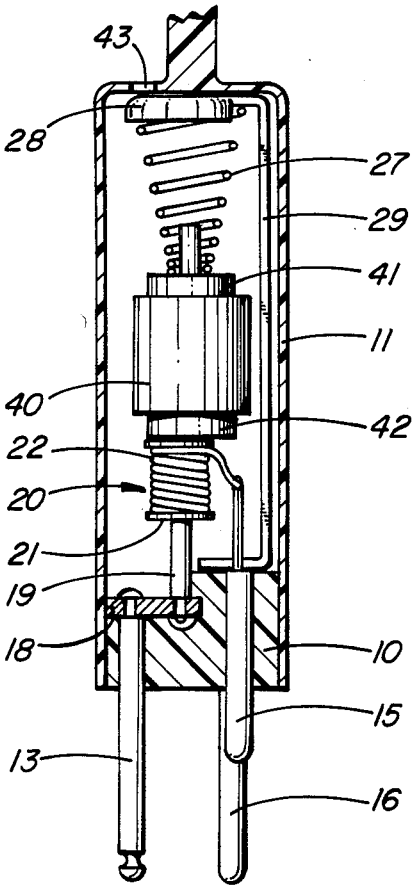
FIG. 9 is a cross-section similar to that of FIG. 2, illustrating an alternative form of protector.

FIG. 9 illustrates a modification to the protector of FIG. 2, using a carbon block protector. The particular form of carbon block protector is not of importance and in the example two carbon blocks are positioned in a ceramic housing 40, the carbon blocks extending out the ends of the housing at 41 and 42. The blocks are separated within the housing, for example by a ring of insulating material, and are not sealed to the housing 40. The spring 27 rests on the outer end of one carbon block, or electrode, and the outer end of the other carbon block or electrode rests on the spool 21. An aperture 43 in the top of the housing 11 enables testing to be carried out.

What is claimed is:

1. A method of manufacturing a heat coil assembly for a protector unit, comprising:

providing a pin, a plate, a terminal, a spool, a coil, and a fusible alloy layer;

attaching one end of said pin to said plate;

attaching one end of said terminal to said plate;

attaching said spool to the other end of said pin by fusing said fusible alloy layer to both said spool and said pin; and winding said coil on said spool after said spool is fused to said pin.

2. A method as claimed in claim 1 further comprising the step of connecting a free end of said coil to a second terminal.

3. A method as claimed in claim 1 further comprising the steps of connecting said first terminal to an outside line and connecting said second terminal to a central office line.

4. A method of manufacturing a heat coil assembly for a protection unit as recited in claim 1 further comprising:

forming the plate into a substantially flat longitudinally elongate shape, with holes through the plate substantially near the ends of the plate along a longitudinal axis; and attaching the pin and the terminal through the holes in the plate.

5. A method of manufacturing a heat coil assembly for a protection unit as recited in claim 4 further 6. A method of installing a heat coil assembly into a protector unit, comprising:

providing a pin, a plate, a pair of terminals, a spool, a coil, a fusible alloy layer, a base having a plurality of bores, a spring, a protector, and a ground member having a cup at one end and a ground terminal at another end;

attaching one end of said pin to said plate;

attaching one end of one of said terminals to said plate;

attaching said spool to the other end of said pin by fusing said fusible alloy layer to both said spool and said pin;

winding said coil on said spool after said spool is fused to said pin, so as to form a heat coil assembly;

positioning said pin in one of said bores; comprising forming the substantially flat plate to be of a length such that the plate does not extend over a central office terminal.

7. A method of installing a heat coil assembly into a protection unit, comprising:

providing a pin, a plate, a pair of terminals, a spool, a coil, a fusible alloy layer, a base having a plurality of bores, a spring, a protector, and a ground member having a cup at one end and a ground terminal at another end;

attaching one end of said pin to said plate;

attaching one end of one of said terminals to said plate;

attaching said spool to the other end of said pin by fusing said fusible alloy layer to both said spool and said pin;

winding said coil on said spool after said spool is fused to said pin, so as to form a heat coil assembly;

positioning said pin in one of said bores;

attaching a free end of said coil to the other of said terminals;

positioning the bottom end of said protector on said spool;

positioning the bottom end of said spring on the top end of said protector;

inserting the ground terminal of said ground member into a bore of said base;

fitting the cup of said ground member over the top end of said spring after inserting the ground terminal of said ground member into said base; and inserting said heat coil assembly into the protector unit;

connecting said first terminal to an outside line and connecting said second terminal to a central office line.

8. The method of installing a heat coil assembly into a protection unit as recited in claim 7 further comprising;

forming the plate into a substantially flat longitudinally elongated shape, with holes through the plate substantially near the ends of the plate along a longitudinal axis; and attaching the pin and the terminal through the holes in the plate.

9. The method of installing a heat coil assembly into a protector unit as recited in claim 8, further comprising;

forming the substantially flat plate to be a length such that the plate does not extend over a central office terminal.

* * * * *

UNITED STATES PATENT AND TRADEMARK OFFICE

CERTIFICATE OF CORRECTION

PATENT NO. : 4,817,270

DATED : April 4, 1989

INVENTOR(S) : Eric A. SCHEITHAUER

It is certified that error appears in the above-identified patent and that said Letters Patent is hereby corrected as shown below: Claims 5 and 6 should read as follows:

5. A method of manufacturing a heat coil assembly for a protection unit as recited in claim 4 further comprising forming the substantially flat plate to be of a length such that the plate does not extend over a central office terminal.

6. A method of installing a heat coil assembly into a protector unit, comprising:

providing a pin, a plate, a pair of terminals, a spool, a coil, a fusible alloy layer, a base having a plurality of bores, a spring, a protector, and a ground member having a cup at one end and a ground terminal at another end;

attaching one end of said pin to said plate;

attaching one end of one of said terminals to said plate;

attaching said spool to the other end of said pin by fusing said fusible alloy layer to both said spool and said pin;

winding said coil on said spool after said spool is fused to said pin, so as to form a heat coil assembly;

positioning said pin in one of said bores;

attaching a free end of said coil to the other of said terminals;

positioning the bottom end of said protector on said spool;

positioning the bottom end of said spring on the top end of said protector;

inserting the ground terminal of said ground member into a bore of said base;

fitting the cup of said ground member over the top end of said spring after inserting the ground terminal of said ground member into said base; and

UNITED STATES PATENT AND TRADEMARK OFFICE

CERTIFICATE OF CORRECTION

PATENT NO. : 4,817,270

DATED : April 4, 1989

INVENTOR(S) : Eric A. SCHEITHAUER

It is certified that error appears in the above-identified patent and that said Letters Patent is hereby corrected as shown below:

inserting said heat coil assembly into the protector unit.

Signed and Sealed this

Thirtieth Day of July, 1991

*Attest:*

*Attesting Officer*

HARRY F. MANBECK, JR.

*Commissioner of Patents and Trademarks*